United States Patent [19]

Urech

[11] Patent Number: 4,651,891

[45] Date of Patent: Mar. 24, 1987

[54] TEAR-OPEN CAN MEMBER

[75] Inventor: Werner Urech, Kaiserstuhl, Switzerland

[73] Assignee: Elpatronic Ag, Switzerland

[21] Appl. No.: 848,956

[22] Filed: Apr. 7, 1986

[51] Int. Cl.[4] ..... B65D 17/36

[52] U.S. Cl. ..... 220/274

[58] Field of Search ..... 220/274, 276, 269–273

[56] References Cited

U.S. PATENT DOCUMENTS 2,753,075 7/1956 Geertsen ..... 220/274

2,806,628 9/1957 Merrill et al. ..... 220/274

*Primary Examiner*—George T. Hall

*Attorney, Agent, or Firm*—McCormick, Paulding & Huber

[57] ABSTRACT

The can member (10) is provided with a pair of scorings (16) which define a tear-off strip (18) laterally. A tongue (20) produced as a separate sheet-metal part is welded onto the tear-off strip (18) in a welding zone (42) at one of its ends. Between the welding zone (42) and the free end (32) of the tongue (20), a starting scoring (30) extends over the tear-off strip (18) to within the vicinity of the two lateral scorings (16). The starting scoring (30) is part of a field (28) of a plurality of scorings formed on the tear-off strip (18) below the tongue (20). The welding zone (42) partially covers over this field (28). As a result, care is taken to ensure that a tearing open operation can be reliably initiated by rolling up the tongue, substantially regardless of inaccuracies in manufacture.

10 Claims, 8 Drawing Figures

TEAR-OPEN CAN MEMBER

Figure 1:
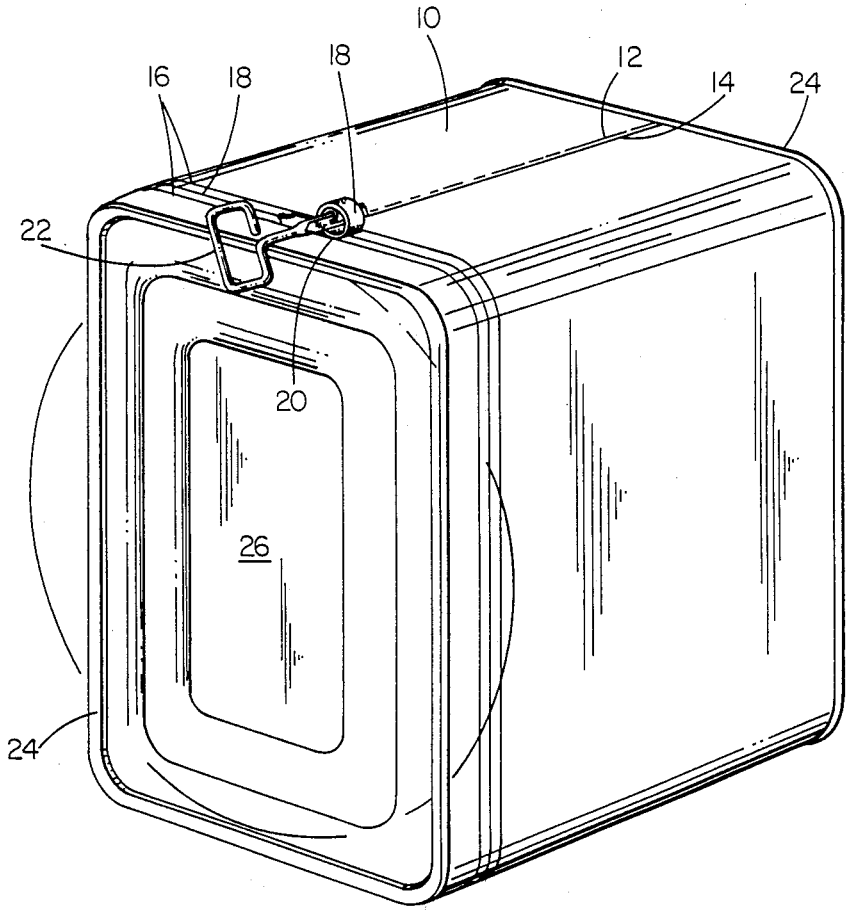

The invention relates to a tear-open can member of sheet metal having (a) a pair of scorings which define a tear-off strip laterally, (b) a tongue which is welded as a separate sheet-metal member, in a welding zone at one of its ends, to the tear-off strip, (c) and a starting scoring which extends between the welding zone and the free end of the tongue, over the tear-off strip to within the vicinity of the two lateral scorings.

In a known can member (DE-C No. 1 017 042), the tongue is punched out in one piece, together with a sheet-metal blank which is plane in the initial state, and extends in its plane beyond one of two longitudinal edges of the sheet-metal blank. Together with the two scorings which define the tear-off strip laterally, a starting scoring which connects these scorings to one another is stamped in the sheet-metal blank in the vicinity of the other longitudinal edge. The sheet-metal blank is then rolled up in such a manner that the two longitudinal edges overlap one another and these are then welded to one another to form a longitudinal seam so that a cylindrical can body results. A complete can is finally produced from this in that the two ends of the can body are closed by beading to a cover and a bottom respectively. In order to tear open the can, a key is placed on the tongue and is rolled on the nearest beaded edge.

With these known cans, inexperienced users in particular do not always succeed at the first attempt in removing the tear-off strip completely in the desired manner. Not infrequently, the tear-off strip tears off already in the region of the longitudinal edges or shortly behind them because converging cracks form, starting from the tongue and meet between the circumferential scorings. The user is then forced to continue the opening of the can with a tool which is not provided for this purpose and there is a danger that he may injure himself on sharp metal edges.

With the intention of making the tearing open operation more reliable, a tear-open can member of the type described at the beginning has been proposed in an earlier Application (U.S. patent application Ser. No. 754,340 filed on July 11, 1985) wherein the starting scoring is formed by a scoring line which extends transversely over the tear-off strip and possibly reaches a short distance beyond each of the two scorings defining the tear-off strip laterally.

Can members in accordance with this earlier proposal, which is not a prior publication, can be torn open satisfactorily if the tongue has been successfully arranged, during the welding on to the tear-off strip, with such accuracy that the starting scoring lies immediately beside the welding zone. If, however, as a result of inaccuracies in manufacture, the welding zone is either too far away from the starting scoring or overlaps this, the starting scoring cannot fulfil its purpose, or can only do so imperfectly, of allowing the tear-off strip first to bend and then to tear off more or less quickly over the whole width between the scorings defining it laterally, during the rolling back of the tongue by means of a key. Inaccuracies in manufacture, which may lead to an unfavourable position of starting scoring and welding zone in relation to one another which makes the tearing open operation more difficult, result from the tolerances during the impressing of the starting scoring, during the punching and handling of the tongue and during the welding itself. If these tolerances are to be kept so small that they do not have a disadvantageous effect on the tearing open operation even in the event of the most unfavourable coincidence, this requires comparatively expensive methods and apparatuses for carrying out the said operations.

It is therefore the object of the invention to develop further a tear-open can member of the type described at the beginning, in such a manner that the tearing open operation is not made appreciably more difficult even by comparatively large inaccuracies in manufacture of the type described.

According to the invention, the problem is solved in that the starting scoring is part of a field of a plurality of scorings formed on the tear-off strip below the tongue and the welding zone partially covers over this field.

The size of the field and the spacing apart of the scorings forming the field can be adapted, as a result of simple experiments, to the thickness of the sheet metal and the other characteristics of the can member and of the tongue and be made dependent on the working accuracy of the manufacturing equipment available in such a manner that even in the event of the most unfavourable coincidence of all the tolerances, the welding zone partially—but only partially—overlaps the field formed by the scorings so that at least one scoring is always not overlapped by the welding zone but is disposed at such a short distance away from it, that this scoring allows the tear-off strip to yield in a pliable way and then tear off when the tongue is rolled up with a key.

It is an advantage if the field extends over two thirds to four fifths of the width of the tear-off strip.

The field is preferably circular or square because it can generally be arranged that the manufacturing tolerances described are approximately equally great in all directions of the plane of the field.

In the preferred form of embodiment of the invention, the field is formed by concentric circular scorings. Such scorings can be produced with a press die which can be manufactured in a particularly simple manner by turning. Above all, however, circular scorings have the advantage that they have particularly little tendency to break open and make the can member useless as a result, if this is exposed to bending and/or tensile loads. Bending loads occur, for example, if the can member in the form of a plane sheet-metal blank is rolled up into a cylindrical can body. In addition, increased bending loads may occur if the filled can is deformed by careless handling. Tensile loads, which may be critical in the region of the starting scoring, occur above all when a can member which is at first rolled up cylindrically is widened to form a parallelepiped or frustoconical body or one in the form of a frustum of a pyramid.

An an alternative to a field of concentric circles, however, a field is also suitable consisting of a plurality of scorings which extend transversely to the tear-off strip and are preferably supplemented by a plurality of scorings which extend in the longitudinal direction of the tear-off strip.

A further alternative consists in that the field comprises a plurality of diagonal scorings crossing one another.

According to a further earlier Application (U.S. patent application Ser. No. 779,885 filed on Sept. 25, 1985), which is not a prior publication, the tongue of a tear-open can member has, at its welded on end, a thickened portion in the form of an arrow directed towards the free end of the tongue. In combination with this feature, the present invention can be further developed in a particularly advantageous manner in that the tip of the arrow-shaped thickened portion is disposed over the middle of the field formed by the starting scoring and a plurality of further scorings.

In this case, the tongue may appropriately comprise, at its under side, over the field, a triangular depression which restricts the welding zone to an arrow-shaped portion of the field. In this manner, the forces created during the rolling up of the tongue by means of a key are concentrated in the middle of the field so that the incipient tear gradually widens out from there, following the edge of the welding zone, until it reaches the longitudinal scorings which define the tear-off strip laterally.

Examples of embodiment of the invention are explained with further details below with reference to diagrammatic drawings.

Figure 2:
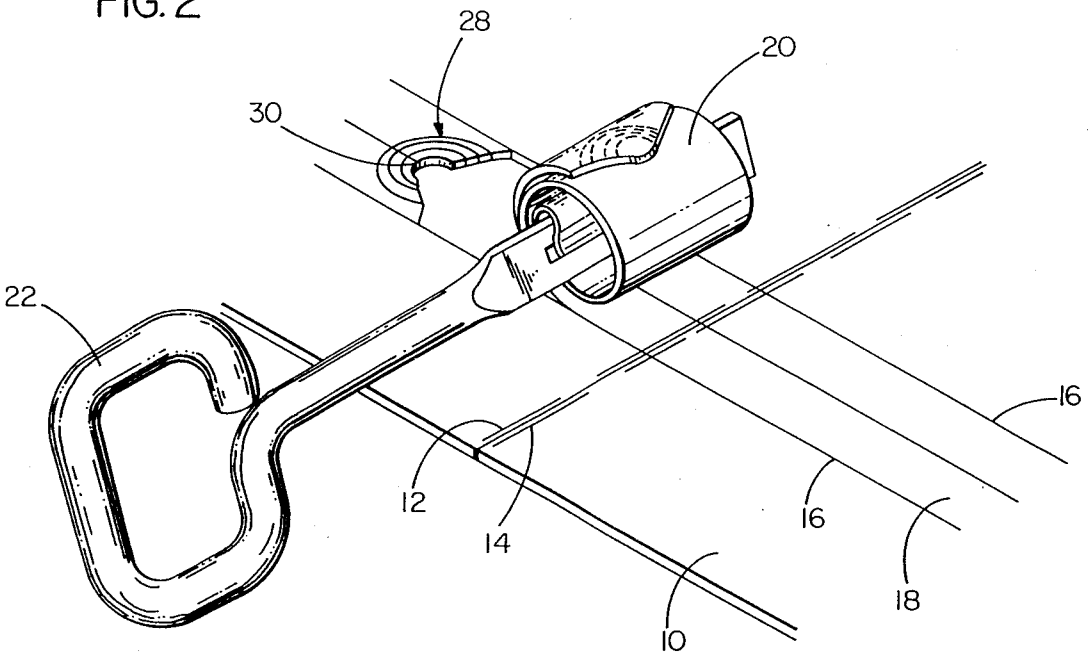
Figure 4:
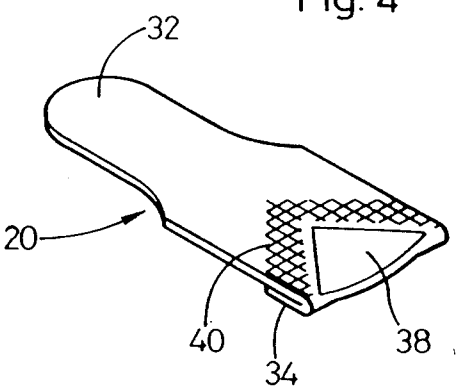
Figure 3:
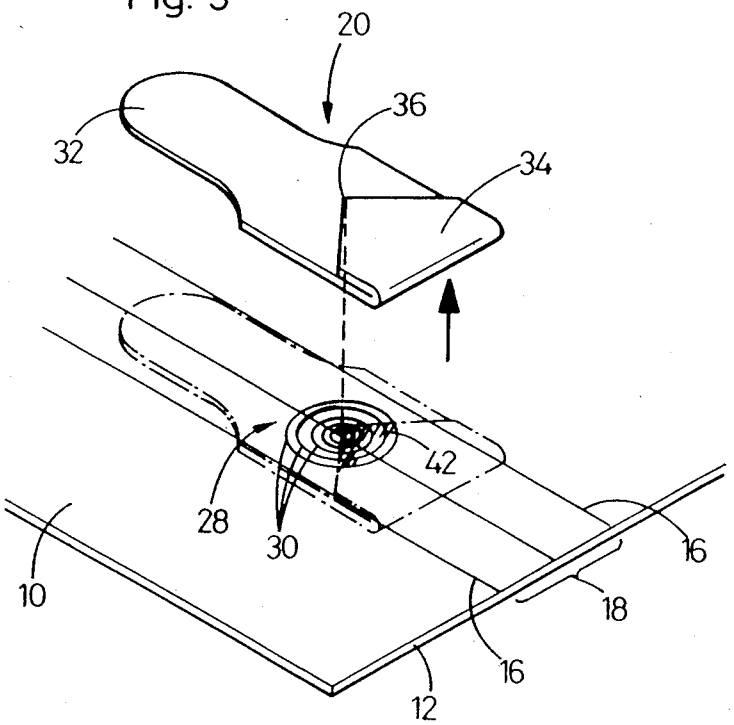
Figure 7:
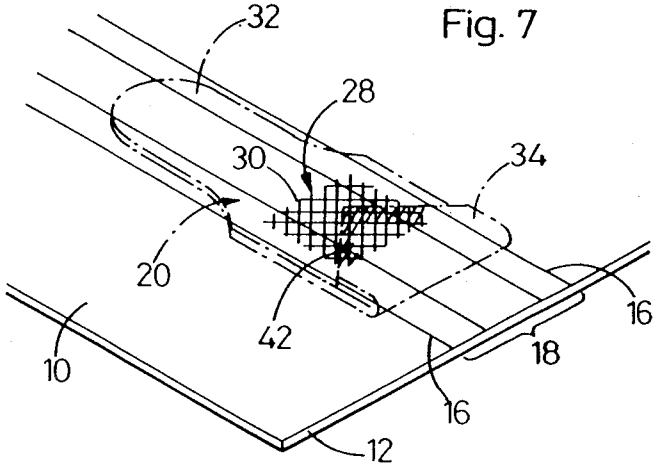
Figure 8:
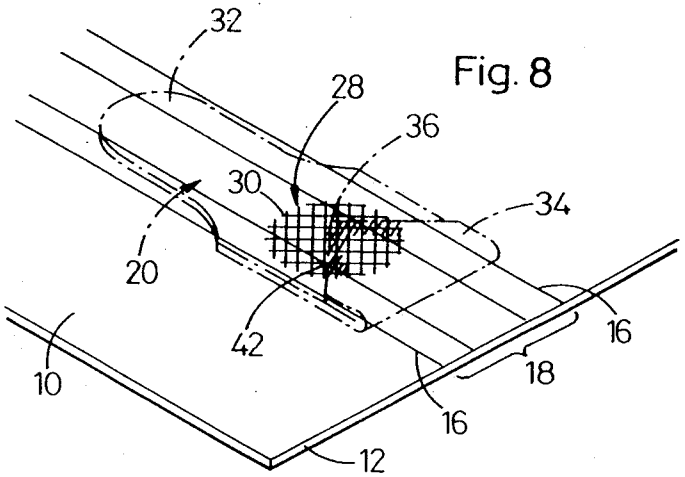

FIG. 1 shows a preserving can in an oblique view at the beginning of the tearing open, FIG. 2 shows an enlarged detail from FIG. 1, FIG. 3 shows a detail of a can member onto which a tongue is being welded, FIG. 4 shows the view of the tongue from below in the direction of the arrow IV in FIG. 3 and FIGS. 5 to 8 show modifications of FIG. 3.

The can member 10 illustrated is an originally rectangular sheet-metal blank with two longitudinal edges 12 and 14. In the course of manufacturing a preserving can, the can member 10 is rolled up to form a cylindrical body as indicated by a circle in FIG. 1. Then the two longitudinal edges 12 and 14 are welded together. The welding seam may be an overlapped mash seam or, as indicated in FIGS. 1 and 2, a butt seam which can be produced by laser welding.

The can member 10 has a pair of parallel scorings 16 which are impressed at right angles to the longitudinal edges 12 and 14 and laterally define a tear-off strip 18 which extends over the whole circumference of the finished can. Welded onto the tear-off strip 18 is a tongue 20 onto which a key 22 can be slipped, as shown in FIGS. 1 and 2, in order to roll up first the tongue 20 and then the whole tear-off strip 18. In the course of this, the key 22 rolls along one of two beaded edges 24 which respectively connect the can member, which is parallelepiped in FIG. 1, to a cover and a bottom 26.

The tear-off strip 18 may comprise, between the two scorings 16 defining it laterally and parallel to these, one (FIGS. 1 to 3) or two (FIGS. 5 to 8) additional longitudinal scorings which likewise extend over the whole circumference of the can.

Impressed in the tear-off strip 18 is a field 28 of a plurality of scorings of which one, in any case, acts as a starting scoring 30 during the rolling up of the tongue 20. The field 28 is disposed at a sufficient distance from the two longitudinal edges 12 and 14 to remain free from any microstructural change in the sheet metal which occurs during the welding of the two longitudinal edges. The width of the field 28 may coincide with that of the tear-off strip 18; in the preferred examples illustrated, however, the field 28 only extends over about three quarters of the width of the tear-off strip. The field 28 can be produced by a press die, preferably when the can member 10 is in the plane state after the impressing of the scorings 16.

According to FIGS. 1 to 3, the field 28 is formed from a plurality of concentric circles in the manner of a target; the common centre of these circles lies as accurately as possible in the middle between the two scorings 16 defining the tongue 20 laterally.

Figure 5:
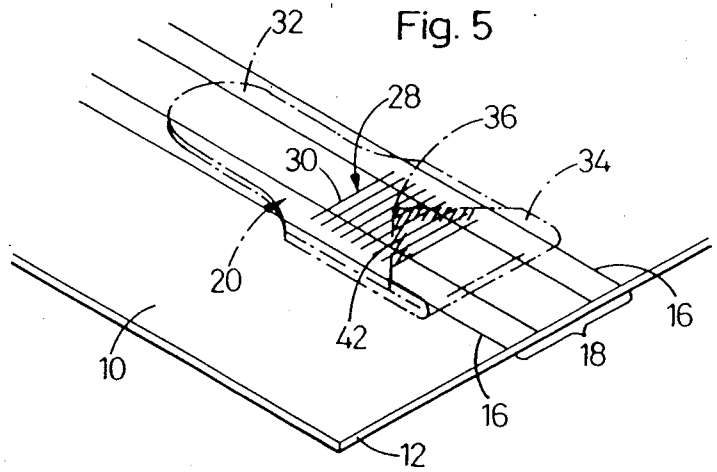
Figure 6:
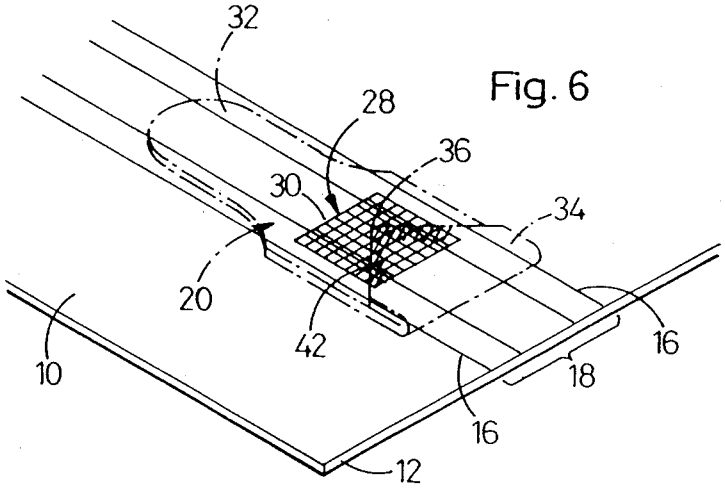

The field 28 may, however, also be formed from differently shaped scorings, particularly rectilinear scorings which extend, for example as shown in FIGS. 5 and 6, at right angles to the lateral scorings 16 while, as shown in FIG. 6, the field 28 may comprise additional scorings which extend parallel to the lateral scorings 16. According to FIGS. 7 and 8, the field 28 may also be formed by diagonal scorings crossing one another. In each of the cases illustrated in FIGS. 5 to 8, the field 28 may be more or less precisely square or circular.

The tongue 20 has a free end 32 which is intended for slipping on the key 22 and which can easily be bent away from the can member 10—for example with a fingernail. The other end of the tongue 20, which is welded to the can member 10, comprises a thickened portion 34 which, in the examples illustrated, has resulted from the fact that an arrow-shaped end portion has been folded back outwards during the punching out of the tongue 20 in such a manner that its tip 36 is directed towards the free end 32.

Impressed in the under side of the tongue 20 is a depression 38 which is likewise arrow-shaped and directed towards the free end 32 but is smaller than the thickned portion 34. The depression 38 is bounded in the direction of the free end 32 of the tongue 20 by a correspondingly arrow-shaped zone 40 which has a honeycomb-like surface structure projecting slightly in relation to the rest of the under side of the tongue.

With each of the configurations of the field 28 illustrated in FIG. 3 and FIGS. 5 to 8, the tongue 20 is arranged, when being welded onto the tear-off strip 18, so that the tip 36 lies as precisely as possible over the middle of the field 28.

During the welding, a particularly satisfactory passage of current results between the arrow-shaped zone 40 structured in a honeycomb-like manner and the field 28, under the influence of a pressure produced by welding electrodes, so that a welding zone 42 is formed where the arrow-shaped zone 40 overlaps the field 28. Thus the welding zone 42 is likewise substantially arrow-shaped but does not extend beyond the field 28 and therefore does not reach the two scorings 16 defining the tear-off strip 18 laterally but overlaps the or each additional longitudinal scoring disposed between the two lateral scorings 16.

What is claimed is:

1. A tear-open can member of sheet metal having a pair of scorings (16) which define a tear-off strip (18) laterally, a tongue (20) which is welded, as a separate sheet-metal part, in a welding zone (42) at one of its ends, to the tear-off strip (18), and a starting scoring (30) which extends between the welding zone (42) and the free end (32) of the tongue (20) over the tear-off strip (18) at least to within the vicinity of the two lateral scorings (16), characterised in that the starting scoring (30) is part of a field (28) of a plurality of scorings formed on the tear-off strip (18) below the tongue (20), and the welding zone (42) partially covers over this field (28).

2. A can member as claimed in claim 1, characterised in that the field (28) extends over two thirds to four fifths of the width of the tear-off strip (18).

3. A can member as claimed in claim 1, characterised in that the field (28) is circular.

4. A can member as claimed in claim 1 characterised in that the field (28) is square.

5. A can member as claimed in claim 3, characterised in that the field (28) is formed from concentric circular scorings.

6. A can member as claimed in claim 1 characterised in that the field (28) comprises a plurality of scorings which extend transversely to the tear-off strip (18).

7. A can member as claimed in claim 6, characterised in that the field (28) additionally comprises a plurality of scorings which extend in the longitudinal direction of the tear-off strip (18).

8. A can member as claimed in claim 1 characterised in that the field (28) comprises a plurality of diagonal scorings crossing one another.

9. A can member as claimed in claim 1 wherein the tongue (20) has, at its welded-on end, a thickened portion (34) in the form of an arrow directed towards the free end (32) of the tongue (20), characterised in that the tip (36) of the arrow-shaped thickened portion (34) is disposed over the middle of the field (28).

10. A can member as claimed in claim 9, characterised in that the tongue (20) comprises, at its under side, over the field (28), a triangular depression (38) which restricts the welding zone (42) to an arrow-shaped portion of the field (28).

* * * * *

UNITED STATES PATENT AND TRADEMARK OFFICE

CERTIFICATE OF CORRECTION

PATENT NO. : 4,651,891

DATED : March 24, 1987

INVENTOR(S) : Werner Urech

It is certified that error appears in the above-identified patent and that said Letters Patent is hereby corrected as shown below:

On the title page insert:

-- [30] Foreign Application Priority Data

April 9, 1985 Switzerland.....1511/85-4 --.

Signed and Sealed this

Nineteenth Day of July, 1988

*Attest:*

DONALD J. QUIGG

*Attesting Officer*

*Commissioner of Patents and Trademarks*